US009989193B2

(12) United States Patent
Johnson et al.

(10) Patent No.: US 9,989,193 B2
(45) Date of Patent: Jun. 5, 2018

(54) NATURAL GAS LEAKAGE DETECTION DEVICE

(71) Applicant: International Business Machines Corporation, Armonk, NY (US)

(72) Inventors: Michael J.A. Johnson, Awbridge (GB); James S. Taylor, Fareham (GB)

(73) Assignee: INTERNATIONAL BUSINESS MACHINES CORPORATION, Armonk, NY (US)

( * ) Notice: Subject to any disclaimer, the term of this patent is extended or adjusted under 35 U.S.C. 154(b) by 154 days.

(21) Appl. No.: 14/950,291

(22) Filed: Nov. 24, 2015

(65) Prior Publication Data

US 2017/0146196 A1 May 25, 2017

(51) Int. Cl.
*F17D 5/06* (2006.01)
*F17D 5/02* (2006.01)

(52) U.S. Cl.
CPC ..... *F17D 5/06* (2013.01); *F17D 5/02* (2013.01)

(58) Field of Classification Search
CPC ..... F17D 5/02; F17D 5/06
See application file for complete search history.

(56) References Cited

U.S. PATENT DOCUMENTS 2,747,112 A * 5/1956 Deziel ..... F23N 5/082 307/132 EA
5,126,934 A * 6/1992 MacFadyen ..... F17D 1/04 137/487.5
7,987,698 B2 8/2011 Nakano et al.
8,176,112 B2 * 5/2012 Hicks, IIII ..... H04L 12/2825 709/200

(Continued)

FOREIGN PATENT DOCUMENTS

CN 203928029 U 11/2014
CN 104723344 A 6/2015

(Continued)

OTHER PUBLICATIONS

Fraiwan, Luay, et al., "A Wireless Home Safety Gas Leakage Detection System"; http://ieeexplore.ieee.org/stamp/stamp.jsp?tp=&arnumber=5752053 capeture Oct. 21, 2015; 11-14 pages.

(Continued)

*Primary Examiner* — Daniel S Larkin
*Assistant Examiner* — Nathaniel Kolb
(74) *Attorney, Agent, or Firm* — Cantor Colburn LLP; Richard Wilhelm

(57) ABSTRACT

An aspect of the disclosure includes a natural gas leakage detection device. The natural gas leakage device includes a metering interface for detecting usage of natural gas. A clock is provided to determine time of day and one or more predetermined times when no natural gas usage is expected. A first sensor is used to determine whether a furnace is operating. A monitoring device is provided. The monitoring device being operable during the one or more predetermined times when no natural gas usage is expected, to monitor the metering interface and the first sensor and to perform an action in response to natural gas usage being detected during the one or more predetermined times when no natural gas usage is expected and the first sensor determines that the furnace is not operating.

10 Claims, 3 Drawing Sheets

(56) References Cited

U.S. PATENT DOCUMENTS

| | | | | |
|---|---|---|---|---|
| 2009/0100492 | A1* | 4/2009 | Hicks, III | H04L 12/2825 725/127 |
| 2016/0189513 | A1* | 6/2016 | Sloo | G08B 21/02 340/522 |
| 2016/0238257 | A1* | 8/2016 | Huang | F24C 3/126 |
| 2017/0149076 | A1* | 5/2017 | Kojima | H01M 8/04701 |

FOREIGN PATENT DOCUMENTS

| | | | | |
|---|---|---|---|---|
| CN | 204375121 | U | 6/2015 | |
| CN | 204496663 | U | 7/2015 | |
| WO | WO 2015129277 | A1 * | 9/2015 | H01M 8/04303 |

OTHER PUBLICATIONS

Priya, K. Padma, et al., "Smart Gas Cylinder Using Embedded System"; International Journal of Innovative Research in Electrical, Electronics, Instrumentation and Control Engineering; Col. 2, Issue 2, Feb. 2014; 958-962 pages.

* cited by examiner

NATURAL GAS LEAKAGE DETECTION DEVICE

BACKGROUND

The present invention relates to leakage detection devices and more particularly to devices for detecting the leakage of natural gas and for taking appropriate actions upon such detection.

SUMMARY

Embodiments of the invention provide a system comprising: a metering interface for detecting usage of natural gas; a clock to determine time of day and one or more predetermined times when no natural gas usage is expected; a first sensor to determine that a furnace is operating; and a monitoring device, the monitoring device operable during the one or more predetermined times when no natural gas usage is expected, to monitor the metering interface and the first sensor and to take an action if natural gas usage is detected during the one or more predetermined times when no natural gas usage is expected and the first sensor determines that the furnace is not operating.

Embodiments of the invention also provide a method and a computer program product for detecting natural gas leakage and a computer program for detecting natural gas leakage.

Additional features and advantages are realized through the techniques of the present invention. Other embodiments and aspects of the invention are described in detail herein and are considered a part of the claimed invention. For a better understanding of the invention with the advantages and the features, refer to the description and to the drawings.

BRIEF DESCRIPTION OF THE DRAWINGS

The subject matter which is regarded the present invention is particularly pointed out and distinctly claimed in the claims at the conclusion of the specification. The forgoing and other features, and advantages of the invention are apparent from the following detailed description taken in conjunction with the accompanying drawings in which:

DETAILED DESCRIPTION

Figure 1:
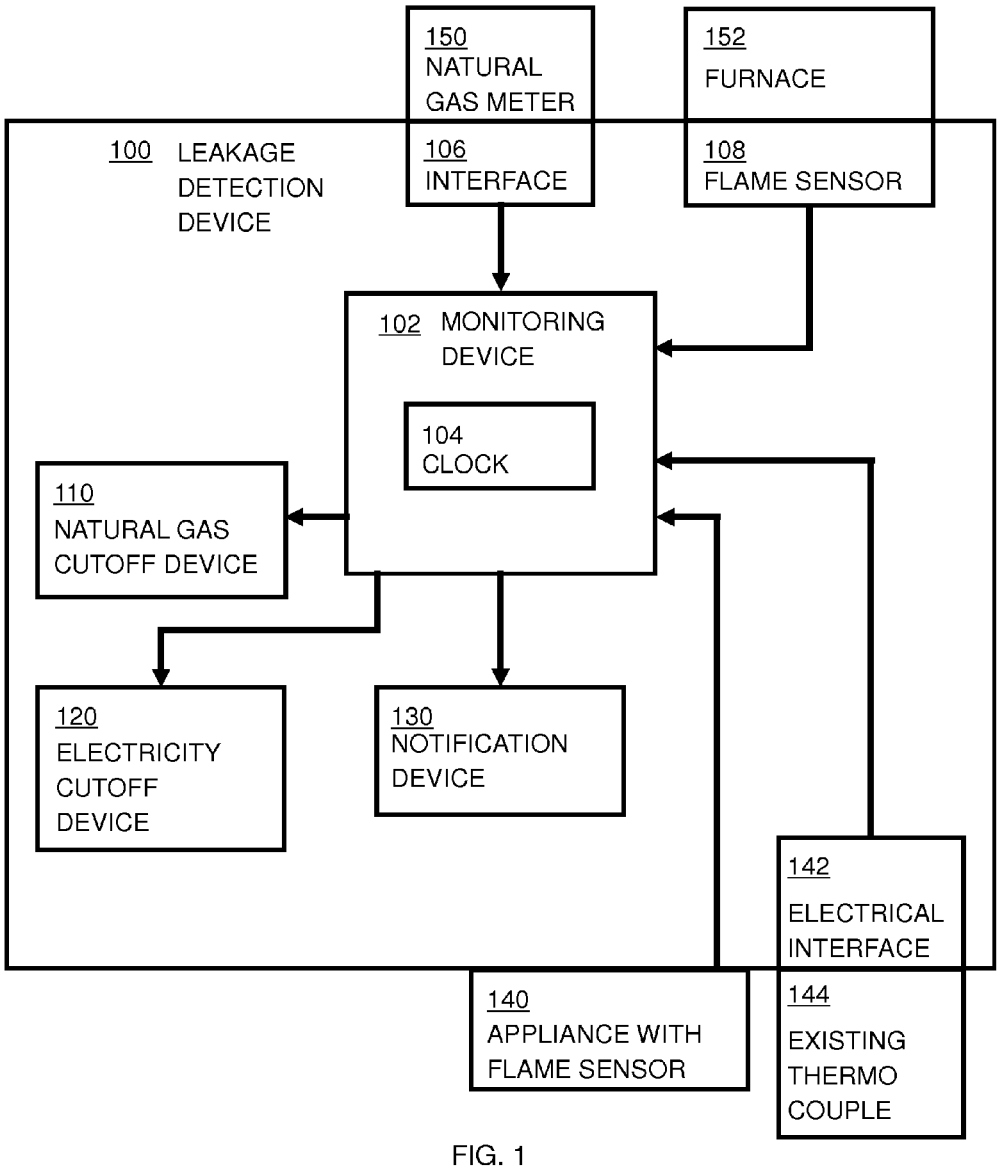
FIG. 1 shows a block diagram of a natural gas leakage detection device according to an embodiment of the present invention.

Devices to try and reduce the risk of leakage of unburnt natural gas in domestic properties comprise a first type, warning devices, that warn of the leakage of unburnt natural gas and a second type, active devices, that attempt to prevent the leakage of unburnt natural gas. Warning devices sense natural gas levels through monitoring the air quality and provide a warning when levels of natural gas are detected. Warning devices are not able to solve the problem completely because of the nature of natural gas may allow it to build up in pockets, for example, in building voids, where a sensor cannot detect them from the locations where the sensors are generally placed. Active devices sense the presence or absence of a flame on natural gas cooktops, ovens, broilers or furnaces. Active devices work well at protecting from accidental natural gas discharge from appliances and may be fitted to furnaces. Some stovetops have them fitted, but, at least in some countries, they are not legally required to be fitted and so most budget stovetops do not. Many ovens have them, but most entry level broilers do not.

When such active devices are fitted they provide almost total protection from a natural gas leak at the intended outlet, due to their nature of failing safe when they break. However they may not protect the many appliances which have no such active device, known as a flame sensor. They may also not protect from faults at other locations in the appliance, for example, the natural gas tap or a bayonet connection between the application and the distribution pipework. Also they may not provide protection for leaks in the distribution pipework of the home.

Smarter home technology may be added to the detection of gas leaks. It is possible to detect that a natural gas leak is occurring by combining together the following assumptions:

(i) There will be periods of time where no natural gas is consumed. Even when a furnace is on 24/7, it is not firing all the time as the circulated water in the heating system reaches the required temperature even when the room thermostat is calling for heat.

(ii) During certain hours of the night we can assume that no other natural gas is being used. For example, cooking at 2 am is improbable and even for those who do cook at that time, there will be other pre-configurable times when it can be assumed that there will be no cooking.

(iii) Natural gas usage can be detected using the pulsed output available from the majority of natural gas meters in homes.

Embodiments of the present disclosure look for natural gas usage during pre-configured times when non furnace natural gas usage is not expected, such as, for example, between 2 am and 5 am. When usage is detected, then a check is made to determine whether the furnace is currently firing. If the furnace is not firing then an action is taken. This action may be to sound an alarm, cut off the natural gas supply, cut off the electricity supply or a combination of more than one of these actions. Sounding an alarm may indicate to a user that they need to relocate away from the property. In an embodiment, the alarm may include spoken words, such as "do not switch on the light, move away from the property". The action of only turning off the natural gas may help but it may not help if the leak occurred for many hours before the active sensing time, such as, for example from 5 am until 2 am the next day at the start of the pre-configured time. The action of turning off the electricity supply to the property may prevent the user from turning on a light by accident. Care needs to be taken that the turning off of the electricity supply does not in itself create a spark via a relay deactivating in an appliance somewhere in the home. In an embodiment, only the lighting circuit or circuits are deactivated.

FIG. 1 shows a block diagram of a natural gas leakage detection device 100 according to an embodiment of the present invention. Monitoring device 102 includes a time of day clock 104 to determine the time of day. Associated with the time of day clock 104 is a set of one or more "non-furnace appliance usage free times", when it is known that there should be no usage of appliances other than a furnace, meaning that no natural gas usage is expected. This set of one or more times will be referred to as "device active times". In an embodiment, the device active times may be predetermined or pre-configured. In another embodiment, the device active times may be set up by a user or installer upon installation of the leakage detection device. In yet another embodiment, the device active times may be learned via detection of the times when there is no non-furnace appliance usage.

Metering interface 106 receives information so as to detect natural gas usage from natural gas meter 150. This information may be received through a wired connection, which is typically a pulse being sent to the interface 106 each time a given amount of natural gas used. The information may also be received through a magnetic connection, or indeed through any other means of providing a signal representative of natural gas usage. Many natural gas meters 150 already have such an output. Natural gas meter 150 is not part of leakage detection device 100.

Flame sensor 108 receives information so as to determine whether the furnace 152 is firing or not. Flame sensor 108 may be a light dependent resistor attached to a sight glass of the furnace. Flame sensor 108 may be a flame sensor placed into the natural gas flame. Flame sensor 108 may be an interface to an existing furnace flame sensor from which it receives an electrical signal indicating the presence of a flame and thus that the burner of the furnace 152 is firing. Flame sensor 108 may be a light dependent resistor placed over a "furnace firing" light present on the furnace. In all of the above examples, the light dependent resistor may be substituted by any other light dependent component, such as a light dependent semiconductor device. Furnace 152 is not part of the leakage protection device 100.

Monitoring device 102 is operable during the one or more predetermined or device active times when no natural gas usage is expected and checks flame sensor 108 to see if furnace 152 is firing. If the furnace 152 is not firing and natural gas usage is detected by monitoring interface 106 to natural gas meter 150, then monitoring device 102 causes one or more of natural gas cutoff device 110, electricity cutoff device 120 or notification device 130 to operate.

Embodiments of the invention may further comprise a natural gas cutoff device 110 which in response to a signal from monitoring device 102 cuts off the natural gas supply. In a variation of this embodiment, natural gas cutoff device 110 may respond to the absence of a signal from monitoring device 102 to cut off the natural gas supply. In this variation, monitoring device 102 provides a signal to natural gas cutoff device 110 in normal operation, removing the signal under fault conditions. This variation provides a failsafe mode of operation.

Other embodiments of the invention may further comprise an electricity cutoff device 120 which in response to a signal from monitoring device 102 cuts off the electricity supply. In a variation of this embodiment, electricity cutoff device 120 may respond to the absence of a signal from monitoring device 102 to cut off the electricity supply. In this variation, monitoring device 102 provides a signal to electricity cutoff device 120 in normal operation, removing the signal under fault conditions. This variation provides a failsafe mode of operation.

Other embodiments of the present disclosure may further comprise a notification device 130, which in response to a signal from the monitoring device 102 provides an audible and/or visual notification of an error and/or normal operation. In a variation of this embodiment, notification device 130 may respond to the absence of a signal from monitoring device 102 to provide a notification. In this variation, monitoring device 102 provides a signal to notification device 130 in normal operation, removing the signal under fault conditions. This variation provides a failsafe mode of operation.

Yet further embodiments of the invention may further comprise additional flame sensors located on other appliances 140 such as stovetops, ovens or broilers. These operate in a similar manner to flame sensor 108 to provide information as to whether these other appliances are in use. In a variation of this embodiment, an electrical interface 142 to an existing thermocouple 144 may be used. Neither the appliances with flame sensors 140 nor the existing thermocouple are part of the leakage protection device 100. If every appliance 152, 140 that is connected to the gas distribution pipework has an interface and provides information to the monitoring device 102, then the clock 104 and set of one or more device active times is not needed and the monitoring device 102 may detect natural gas leakage at any time of the day. This allows the natural gas supply to be cut off so as to prevent any significant natural gas leakage.

In an embodiment, monitoring device 102 may be connected to a security alarm, so as to detect when there are no people in the house. The action taken in this embodiment may be different to that taken when the house is occupied. Further, notification device may provide a remote notification to, for example, a cellphone.

Figure 2:
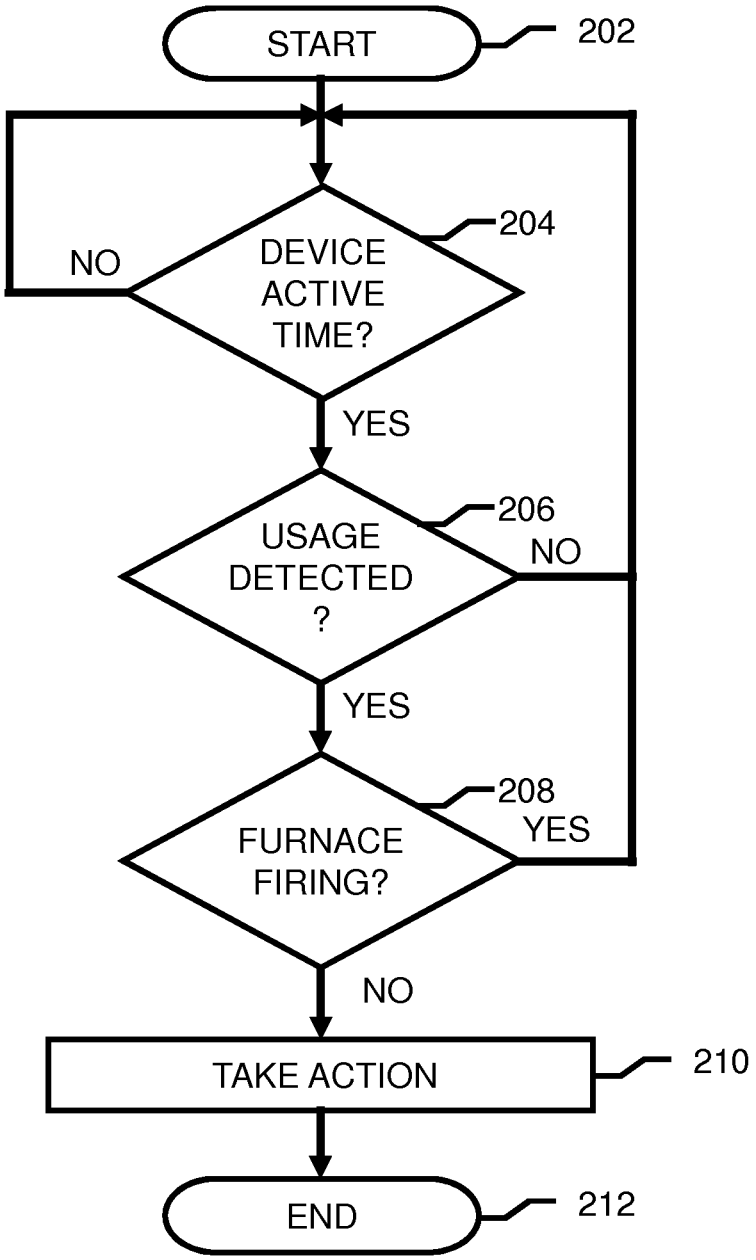
FIG. 2 shows a flow diagram of an embodiment of a method of detecting natural gas leakage according to the present invention.

FIG. 2 shows a flow diagram of an embodiment of a method according to the present disclosure. The method starts at step 202. At step 204, a check is made by the natural gas leakage device 102 as to whether the time is during a device active time. If it is not, that is, if it is expected that there may be usage of natural gas by one or more appliances, then processing returns to step 204. In the example above, this might be during the period from 5 am through the day until 2 am. If it is, that is, if it is not expected that there may be usage of natural gas by one or more appliances, then processing proceeds to step 206. In the example above, this might be during the period from 2 am until 5 am. At step 206, a check is made by natural gas leakage device 102 through interface 106 to natural gas meter 150 as to whether there is any usage of natural gas. If no usage is detected, then processing returns to step 204. If usage is detected, then processing continues to step 208. At step 208, a check is made by natural gas leakage detector 102 using flame sensor 108 as to whether furnace 152 is firing. If furnace 152 is firing, then processing returns to step 204. If furnace 152 is not firing, then processing proceeds to step 210. At step 210, an action is taken because it is expected that there should be no usage of natural gas and because the furnace 152 is not firing. It is assumed that there may be leakage of natural gas. As explained above, that action may be to sound an alarm through notification device 130, to cut off the natural gas supply through natural gas cutoff device 110, to cut off the electricity supply through electricity cutoff device 120 or a combination of more than one of these actions. The method ends at step 212.

In a variation of the above embodiments, instead of being used to detect a leakage of natural gas, the leakage device may detect the leakage of bottled gas, for example, in a mobile home, a recreational vehicle or a boat. In this embodiment, a metering sensor may need to be added to the bottled gas distribution system as such a system will typical not have a meter.

Figure 3:
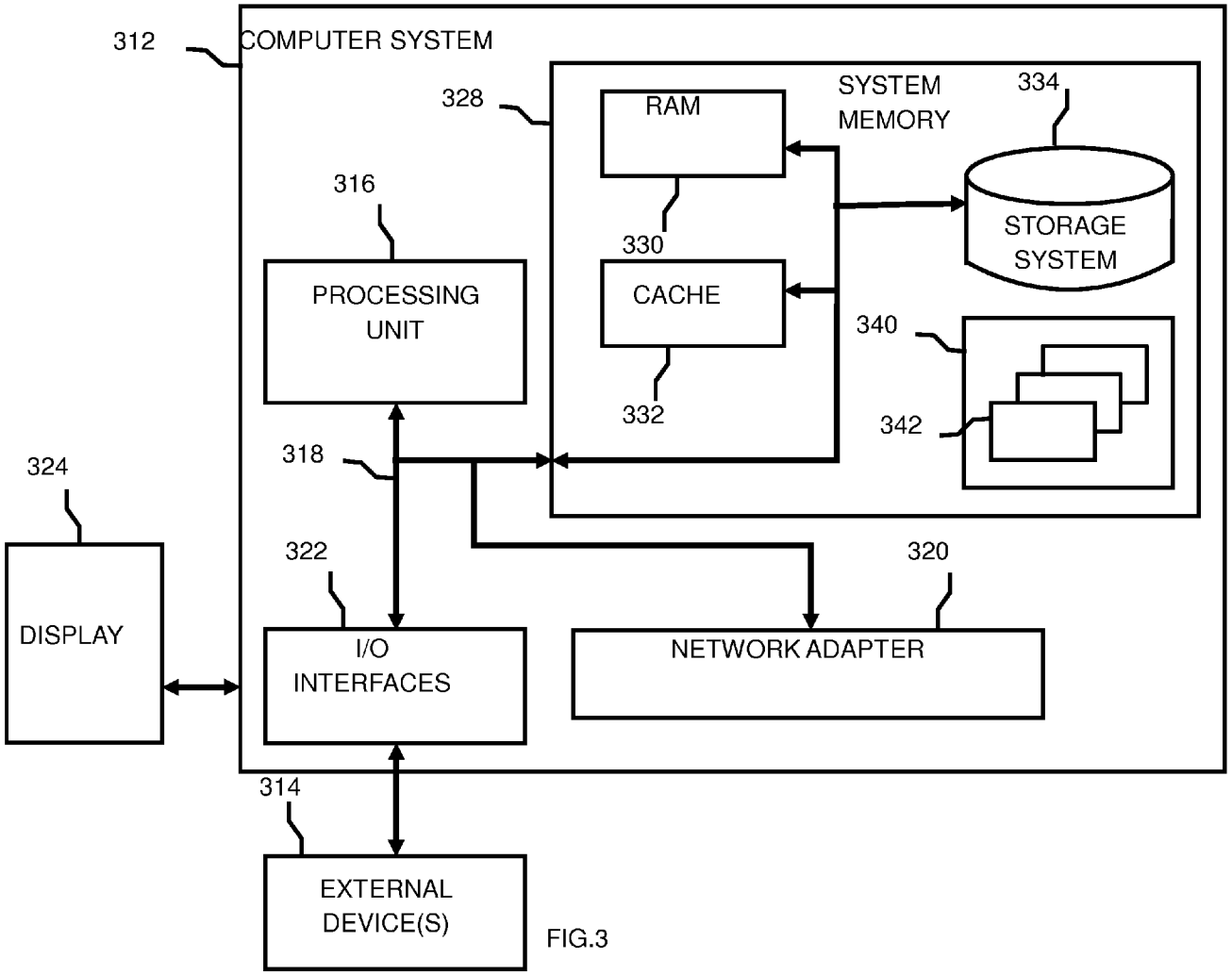
FIG. 3 shows a computer system in which embodiments of the present invention may be implemented.

Referring now to FIG. 3, a schematic of an example of computing system is shown. Computing system 312 is only one example of a suitable computing system and is not intended to suggest any limitation as to the scope of use or functionality of embodiments of the invention described herein. Regardless, computing system 312 is capable of being implemented and/or performing any of the functionality set forth hereinabove.

Computer system/server 312 is operational with numerous other general purpose or special purpose computing system environments or configurations. Examples of well-known computing systems, environments, and/or configurations that may be suitable for use with computer system/server 312 include, but are not limited to, personal computer systems, server computer systems, thin clients, thick clients, hand-held or laptop devices, multiprocessor systems, microprocessor-based systems, set top boxes, programmable consumer electronics, network PCs, minicomputer systems, mainframe computer systems, and distributed cloud computing environments that include any of the above systems or devices, and the like.

Computer system/server 312 may be described in the general context of computer system-executable instructions, such as program modules, being executed by a computer system. Generally, program modules may include routines, programs, objects, components, logic, data structures, and so on that perform particular tasks or implement particular abstract data types. Computer system/server 312 may be practiced in distributed cloud computing environments where tasks are performed by remote processing devices that are linked through a communications network. In a distributed cloud computing environment, program modules may be located in both local and remote computer system storage media including memory storage devices.

As shown in FIG. 3, computer system/server 312 is shown in the form of a general-purpose computing device. The components of computer system/server 312 may include, but are not limited to, one or more processors or processing units 316, a system memory 328, and a bus 318 that couples various system components including system memory 328 to processor 316.

Bus 318 represents one or more of any of several types of bus structures, including a memory bus or memory controller, a peripheral bus, an accelerated graphics port, and a processor or local bus using any of a variety of bus architectures. By way of example, and not limitation, such architectures include Industry Standard Architecture (ISA) bus, Micro Channel Architecture (MCA) bus, Enhanced ISA (EISA) bus, Video Electronics Standards Association (VESA) local bus, and Peripheral Component Interconnect (PCI) bus.

Computer system/server 312 typically includes a variety of computer system readable media. Such media may be any available media that is accessible by computer system/server 312, and it includes both volatile and non-volatile media, removable and non-removable media.

System memory 328 can include computer system readable media in the form of volatile memory, such as random access memory (RAM) 330 and/or cache memory 332. Computer system/server 312 may further include other removable/non-removable, volatile/non-volatile computer system storage media. By way of example only, storage system 334 can be provided for reading from and writing to a non-removable, non-volatile magnetic media (not shown and typically called a "hard drive"). Although not shown, a magnetic disk drive for reading from and writing to a removable, non-volatile magnetic disk (e.g., a "floppy disk"), and an optical disk drive for reading from or writing to a removable, non-volatile optical disk such as a CD-ROM, DVD-ROM or other optical media can be provided. In such instances, each can be connected to bus 318 by one or more data media interfaces. As will be further depicted and described below, memory 328 may include at least one program product having a set (e.g., at least one) of program modules that are configured to carry out the functions of embodiments of the invention.

Program/utility 340, having a set (at least one) of program modules 342, may be stored in memory 328 by way of example, and not limitation, as well as an operating system, one or more application programs, other program modules, and program data. Each of the operating system, one or more application programs, other program modules, and program data or some combination thereof, may include an implementation of a networking environment. Program modules 342 generally carry out the functions and/or methodologies of embodiments of the invention as described herein.

Computer system/server 312 may also communicate with one or more external devices 314 such as a keyboard, a pointing device, a display 324, etc.; one or more devices that enable a user to interact with computer system/server 312; and/or any devices (e.g., network card, modem, etc.) that enable computer system/server 312 to communicate with one or more other computing devices. Such communication can occur via Input/Output (I/O) interfaces 322. Still yet, computer system/server 312 can communicate with one or more networks such as a local area network (LAN), a general wide area network (WAN), and/or a public network (e.g., the Internet) via network adapter 320. As depicted, network adapter 320 communicates with the other components of computer system/server 312 via bus 318. It should be understood that although not shown, other hardware and/or software components could be used in conjunction with computer system/server 312. Examples, include, but are not limited to: microcode, device drivers, redundant processing units, external disk drive arrays, RAID systems, tape drives, and data archival storage systems, etc.

The present invention may be a system, a method, and/or a computer program product. The computer program product may include a computer readable storage medium (or media) having computer readable program instructions thereon for causing a processor to carry out aspects of the present disclosure.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, or either source code or object code written in any combination of one or more programming languages, including an object oriented programming language such as Smalltalk, C++ or the like, and conventional procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, column-programmable gate arrays (FPGA), or programmable logic arrays (PLA) may execute the computer readable program instructions by utilizing state information of the computer readable program instructions to personalize the electronic circuitry, in order to perform aspects of the present disclosure.

Aspects of the present disclosure are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

What is claimed is:

1. A natural gas leakage detection device comprising:

a metering interface configured to receive an electronic signal from a natural gas meter, and to detect, based on the electronic signal received from the natural gas meter, usage of natural gas;

a flame sensor configured to receive an electronic signal from a furnace and to determine, based on the received electronic signal from the furnace, whether the furnace is operating; and a monitoring device comprising a time of day clock, wherein the monitoring device is configured to:

transmit an electronic signal to a natural gas cutoff device, wherein the natural gas cutoff device is configured to cut off a natural gas supply to the furnace in response to detecting an absence of the transmitted electronic signal;

monitor both the flame sensor and the metering interface only during one or more predetermined times, wherein the one or more predetermined time periods are periods when no natural gas usage is expected to occur; and in response to the metering interface detecting natural gas usage during the one or more predetermined times when no natural gas usage is expected to occur and the flame sensor determining that the furnace is not operating during the one or more predetermined times when no natural gas usage is expected to occur, cease transmission of the electronic signal to the natural gas cutoff device.

2. The natural gas leakage detection device of claim 1, wherein the monitoring device is further configured to a transmit an electronic signal to an electricity cutoff device, wherein the electricity cutoff device is configured to cut off electricity supply in response to detecting an absence of the electronic signal that was being transmitted to the electricity cutoff device, wherein the monitoring device is further configured to cease transmission of the electronic signal to the electricity in response to the metering interface detecting natural gas usage during the one or more predetermined times when no natural gas usage is expected to occur and the flame sensor determining that the furnace is not operating during the one or more predetermined times when no natural gas usage is expected to occur.

3. The natural gas leakage detection device of claim 1, further comprising one or more sensors connected to one or more appliances using natural gas to determine whether the one or more appliances are being used.

4. The natural gas leakage detection device of claim 3, wherein the one or more predetermined times are twenty four hours a day, and wherein the monitoring device is configured to cease transmission of the electronic signal to the natural gas cutoff device only when each of the one or more sensors determines that no appliance is being used.

5. A method of detecting natural gas leakage via a natural gas leakage detection device comprising a metering interface, a flame sensor, and a monitoring device, the method comprising:

checking, by the monitoring device of the natural gas leakage detection device, via a time of day clock of the monitoring device, whether a current time is within one or more predetermined times when no natural gas usage is expected to occur;

responsive to the current time being within the one or more predetermined times, detecting usage of natural gas via a metering interface of the natural gas leakage detection device, wherein the metering interface is configured to receive an electronic signal from the natural gas meter and configured to detect, based on the electronic signal received from the natural gas meter, usage of natural gas;

responsive to detecting usage of natural gas during the one or more predetermined times when no natural gas usage is expected to occur, determining via the flame sensor whether a furnace is operating, wherein the flame sensor is configured to receive an electronic signal from the furnace and to determine, based on the received electronic signal from the furnace, whether the furnace is operating;

transmitting an electronic signal to a natural gas cutoff device, wherein the natural gas cutoff device is configured to cut off a natural gas supply to the furnace in response to detecting an absence of the transmitted electronic signal; and responsive to detecting via the metering interface, usage of natural gas during the one or more predetermined times when no natural gas usage is expected to occur and determining, via the flame sensor, during the one or more predetermined times when no natural gas usage is expected to occur that the furnace is not operating, ceasing transmission of the electronic signal to the natural gas cutoff device.

6. The method of claim 5 further comprising:

transmitting an electronic signal to an electricity cutoff device, wherein the electricity cutoff device is configured to cut off electricity supply in response to detecting an absence of the electronic signal that was being transmitted to the electricity cutoff device; and ceasing transmission of the electronic signal to the electronic cutoff device in response detecting natural gas usage via the metering interface during the one or more predetermined times when no natural gas usage is expected to occur and determining, via the flame sensor, that the furnace is not operating during the one or more predetermined times when no natural gas usage is expected to occur.

7. The method of claim 5, wherein the one or more predetermined times are twenty four hours a day and further comprising determining from one or more sensors connected to one or more appliances using natural gas whether the appliances are being used.

8. The method of claim 7, wherein the one or more predetermined times is twenty four hours a day, and wherein the ceasing of transmission of the electronic signal to the natural gas cutoff device occurs only when each of the one or more sensors determines that no appliance is being used.

9. The method of claim 7 wherein the determining the appliance is being used includes determination of the presence of a flame.

10. The method of claim 9 wherein the determining the furnace is operating includes determination of the presence of a second flame.

* * * * *